US009889974B2

(12) United States Patent
Kloss et al.

(10) Patent No.: US 9,889,974 B2
(45) Date of Patent: Feb. 13, 2018

(54) CONTAINER SEAL FOR THE STORAGE OF DANGEROUS LIQUID MATERIAL

(71) Applicant: Ardagh MP Group Netherlands B.V., Deventer (NL)

(72) Inventors: Uwe Kloss, Seesen (DE); Birger Keilberg, Seesen (DE); Manfred Hubert, Wolterhausen (DE)

(73) Assignee: ARDAGH MP GROUP NETHERLANDS B.V., Deventer (NL)

( * ) Notice: Subject to any disclaimer, the term of this patent is extended or adjusted under 35 U.S.C. 154(b) by 1019 days.

(21) Appl. No.: 14/176,477

(22) Filed: Feb. 10, 2014

(65) Prior Publication Data

US 2014/0166683 A1 Jun. 19, 2014

Related U.S. Application Data

(63) Continuation of application No. 11/575,594, filed as application No. PCT/DE2005/001691 on Sep. 23, 2005, now Pat. No. 8,657,150.

(30) Foreign Application Priority Data

Sep. 24, 2004 (DE) ..... 10 2004 046 677
Oct. 8, 2004 (DE) ..... 10 2004 049 225

(51) Int. Cl.
*B65D 43/02* (2006.01)
*B65D 85/84* (2006.01)

(52) U.S. Cl.
CPC ..... *B65D 43/0208* (2013.01); *B65D 43/021* (2013.01); *B65D 85/84* (2013.01);
(Continued)

(58) Field of Classification Search
CPC .... B65D 43/021; B65D 43/028; B65D 85/84; B65D 2543/00277; B65D 2543/00972; B65D 2543/00537; B65D 43/028
(Continued)

(56) References Cited

U.S. PATENT DOCUMENTS 505,853 A 10/1893 Schmitz
2,001,748 A 5/1935 Saalbach
(Continued)

FOREIGN PATENT DOCUMENTS

BE 864362 8/1978
BE 898168 3/1984
(Continued)

OTHER PUBLICATIONS

Russian Decision to Grant Issued for 2007104108/12 (004422) dated Sep. 23, 2005.

*Primary Examiner* — King M Chu
*Assistant Examiner* — Blaine Neway
(74) *Attorney, Agent, or Firm* — Hunton & Williams LLP

(57) ABSTRACT

Exemplary embodiments provide a seal between an open body end of a container body and an edge of a lid which is pressable into the open end of the body in a sealing manner, both made from sheet metal, wherein at the end of the body the sheet metal is bent outward by approximately 180° with a bending radius, the lid edge, which is separated from a lid surface by a channeled bead, extending axially upward with its radially external defining edge of the bead beyond an axial position of the lid surface and being bent outwards with a radius which is larger than the bending radius at the body end, to form a rolled edge for receiving an annular sealing material filling the rolled edge and extending downwards, wherein a sheet edge of the rolled edge terminates at a radial distance before the defining edge, said distance being
(Continued)

dimensioned such that during the sealing process the body end, with the bending radius thereof in contact with the defining edge of the lid, may be inserted between the same and the sealing material into the interior of the rolled edge.

14 Claims, 3 Drawing Sheets

(52) U.S. Cl.
CPC ..... *B65D 2543/0062* (2013.01); *B65D 2543/00277* (2013.01); *B65D 2543/00509* (2013.01); *B65D 2543/00537* (2013.01); *B65D 2543/00546* (2013.01); *B65D 2543/00685* (2013.01); *B65D 2543/00731* (2013.01); *B65D 2543/00796* (2013.01); *B65D 2543/00972* (2013.01)

(58) Field of Classification Search
USPC ..... 220/803, 802, 804, 806, 378, 795
See application file for complete search history.

(56) References Cited

U.S. PATENT DOCUMENTS

| | | | | |
|---|---|---|---|---|
| 2,063,557 | A | 12/1936 | Punte | |
| 2,148,468 | A | 2/1939 | Hothersall | |
| 2,382,378 | A * | 8/1945 | Bloedorn | B65D 43/0233 220/310.1 |
| 2,579,974 | A | 12/1951 | Scott et al. | |
| 2,864,528 | A * | 12/1958 | Henchert | B21D 51/2615 220/806 |
| 3,771,688 | A | 11/1973 | Frankenberg et al. | |
| 3,773,208 | A * | 11/1973 | Curry | B65D 43/0218 220/269 |
| 3,902,630 | A | 9/1975 | Knize | |
| 3,915,336 | A | 10/1975 | Spreng | |
| 3,977,563 | A | 8/1976 | Holt | |
| 4,078,696 | A | 3/1978 | Crisci | |
| 4,166,548 | A | 9/1979 | Crisci | |
| 4,337,874 | A | 7/1982 | Hoenig et al. | |
| 4,676,392 | A | 6/1987 | Giggard et al. | |
| 4,742,932 | A | 5/1988 | Pedragosa | |
| 4,846,366 | A | 7/1989 | Satz | |
| 4,881,658 | A | 11/1989 | VanCucha | |
| 4,887,736 | A | 12/1989 | VanCucha | |
| 4,946,064 | A | 8/1990 | VanCucha | |
| 5,065,888 | A | 11/1991 | Gallagher | |
| 5,143,219 | A | 9/1992 | Yates, Jr. | |
| 5,295,603 | A | 3/1994 | Schormair | |
| 5,328,047 | A | 7/1994 | Smith | |
| 5,984,137 | A | 11/1999 | Grosjean | |
| 6,021,917 | A | 2/2000 | Lovell et al. | |
| 6,834,772 | B1 | 12/2004 | Thors.o slashed | |
| 2002/0148846 | A1 | 10/2002 | Luburic | |
| 2002/0148847 | A1 | 10/2002 | Luburic | |
| 2002/0175172 | A1 | 11/2002 | Diesterbeck | |
| 2002/0175173 | A1 | 11/2002 | Diesterbeck | |
| 2002/0175174 | A1 | 11/2002 | Diesterbeck | |
| 2003/0015542 | A1 | 1/2003 | Nulty et al. | |
| 2005/0224499 | A1 | 10/2005 | Jorgensen et al. | |

FOREIGN PATENT DOCUMENTS

| | | |
|---|---|---|
| DE | 33 39 777 | 5/1984 |
| DE | 3837786 | 5/1989 |
| EP | 0 535 383 | 4/1993 |
| EP | 737625 | 10/1996 |
| EP | 791538 | 8/1997 |
| EP | 1495980 | 1/2005 |
| FR | 2 387 855 | 11/1978 |
| FR | 2563812 | 11/1985 |
| FR | 2580258 | 10/1986 |
| FR | 2 658 483 | 8/1991 |
| FR | 2669896 | 6/1992 |
| FR | 2908391 | 5/2008 |
| JP | S59-51044 | 3/1984 |
| JP | H06-42701 | 6/1994 |
| JP | 2005-515129 | 5/2005 |
| RU | 2065390 | 8/1996 |
| WO | WO 92/04248 | 3/1992 |
| WO | WO 9204248 | 3/1992 |
| WO | WO 98/35882 | 8/1998 |
| WO | WO 9835882 | 8/1998 |
| WO | WO 03/062081 | 7/2003 |
| WO | WO 2005-515129 | 5/2005 |

* cited by examiner

CONTAINER SEAL FOR THE STORAGE OF DANGEROUS LIQUID MATERIAL

CROSS REFERENCE TO RELATED APPLICATIONS

This application is a continuation of U.S. patent application Ser. No. 11/575,594, filed on Mar. 20, 2007, which claims the benefit of PCT Application DE2005/001691, filed on Sep. 23, 2005, German Patent Application 10 2004 046 677.7, filed Sep. 24, 2004, and German Patent Application 10 2004 049 225.5, filed Oct. 8, 2004, the contents of which are all incorporated herein by reference in their entirety.

FIELD OF THE DISCLOSURE

The disclosure relates to a seal between the open body end of a container and an edge of a lid that may be pressed into the open body end. The lid may be removable. Both components may be made from (relatively) light gauge sheet metal. It is of primary concern to provide for a particularly safe seal, in particular for liquid hazardous materials, capable to also withstand mechanical impact such as from shock or fall.

BACKGROUND OF THE DISCLOSURE

A seal for a sheet metal container is shown in WO-A 1992/04248 (Baltics). This seal assembly provides for an intermediate ring that receives a seal ring and that contributes to the mechanical safeguarding of the appropriate engagement of the lid in the closed position. For safety, an adhesive is applied to the respective interacting sealing surfaces which interconnect the compound.

SUMMARY OF THE DISCLOSURE

According to an embodiment of the present disclosure a seal may be provided which may possess the requisite high standards pertaining to such seal applications, and may be simpler and more economical to produce.

The insertable lid herein may be essentially similar to existing shapes of lids, allowing for the use of prevailing manufacturing methods and tools. Technical modifications can thus be held to a minimum, constituting an attendant objective of the disclosure rather than impeding the same.

According to an embodiment of the present disclosure, a high degree of leak tightness may be achieved through the (direct) interaction between open body end (end of body) and lid edge (edge of the lid), rendering the use of an additional intermediate ring redundant. In the area of a sharp bend, the open body end may abut against (directly, or indirectly through a residual compound welt) the lid sheet metal (the defining edge) within its at least partially rolled edge (rolled edge) and thus may provide for a seal through direct contact, preferably with an expandable surface, under a reciprocal radial preload.

This area may be, at the same time, covered in the radially peripheral area by the sealing material (compound) provided within the rolled edge of the lid, in particular provided as a swelling compound.

In the course of a closing process, the body end with its bending radius comes into contact with the sealing material on the outside of the defining edge of the lid.

Subsequently several exemplary embodiments illustrate and supplement the disclosure.

DETAILED DESCRIPTION OF PREFERRED EMBODIMENTS

Figure 1:
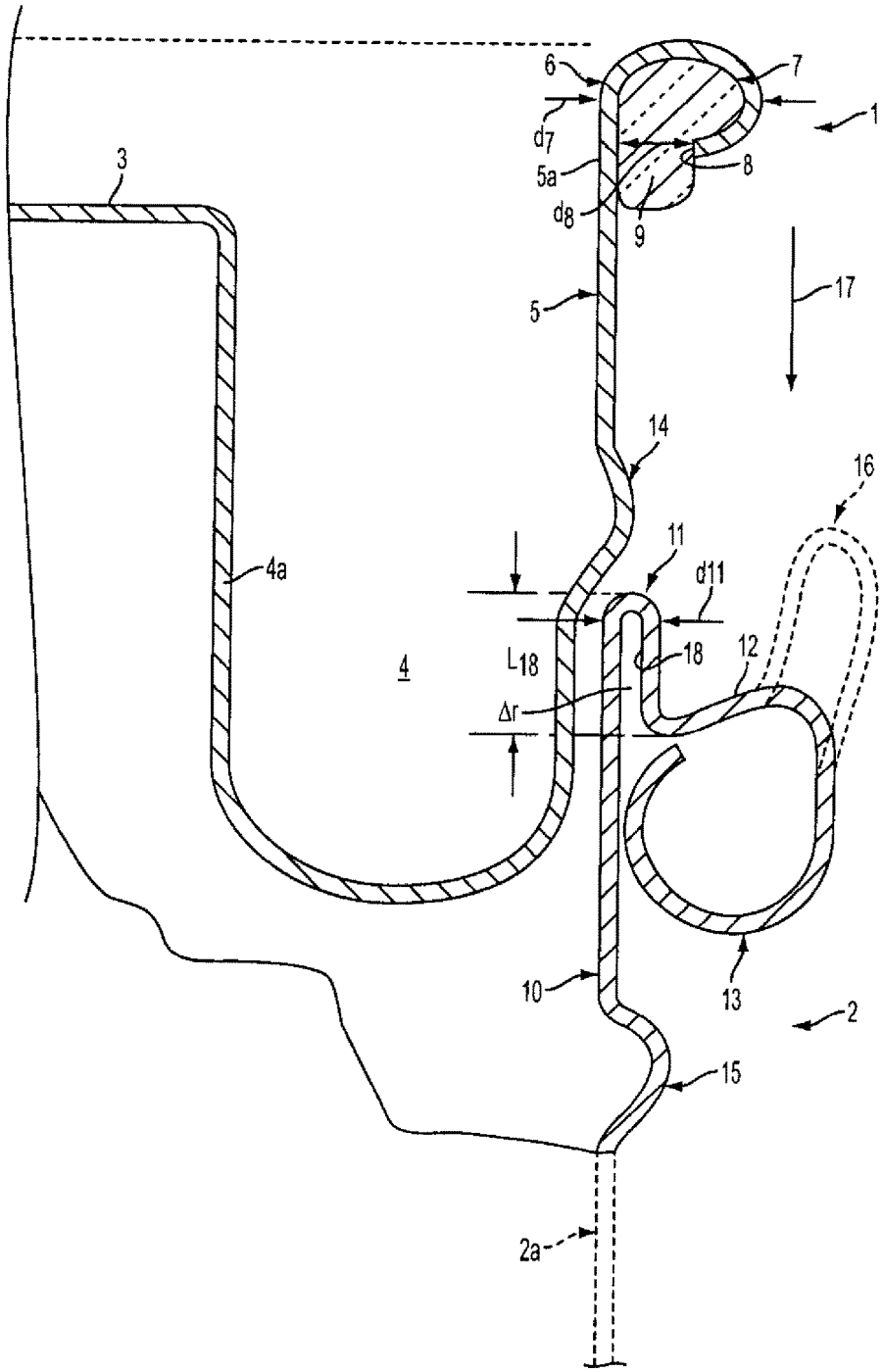
FIG. 1 shows the components of the lid and the open body end of a sealed, or sealable container, or a container that can be opened, which may be relevant to the seal, each in an axial sectional view and with the seal open.

The lid 1 as a component of the seal has an edge (edge section 1) with the lid surface 3 connected through a relatively deep, channel-like bead 4, which can also serve to dampen for example mechanical impacts. Its outer defining edge 5 extends in axial direction past the lid surface 3 and transitions into an outward bent rolled edge 7, whose sheet edge 8 ends at a (distinct) radial distance from the upper section 5*a* of the defining edge 5. The rolled edge has a sufficiently sized bending radius allowing for a sealing material 9 of appropriate volume to be received within it, which extends downward beyond the lower opening slot d8 of the rolled edge 7, over a certain distance alongside the defining edge 5.

The barrel 2*a*,10 of the container 2 (the body) may be bent outward by 180" with a small bending radius 11 in order to provide for the opening of the body or container. The sheet metal 18 extends from the bending radius in the radial distance Δr predetermined by the dimension of the bending radius, in parallel with the barrel 10 of the body and axially downward with a longitudinal dimension L18, which distinctly exceeds the diameter d7 of the rolled edge 7 of the lid 1.

Subsequently, the sheet metal is bent outward in a radially and axially rising manner in order to form a support shoulder 12. At the peripheral edge of the support shoulder, the sheet metal is axially bent downward and ends in a roll-in 13 provided with a large diameter as compared to the rolled edge 7 of the lid or to the diameter dimension d11 of the small or sharp bend 11, the diameter being chosen such that the roll-in 13 is adjacent to the body wall 10 with its radially interior section or even abuts against it.

In a modification the body sheet metal can be shaped, at least in a given section, between the support shoulder 12 and the roll-in 13, into an outwardly protruding opening aid 16, as depicted in dashed lines in FIG. 1, as a protruding lug 16.

Figure 2:
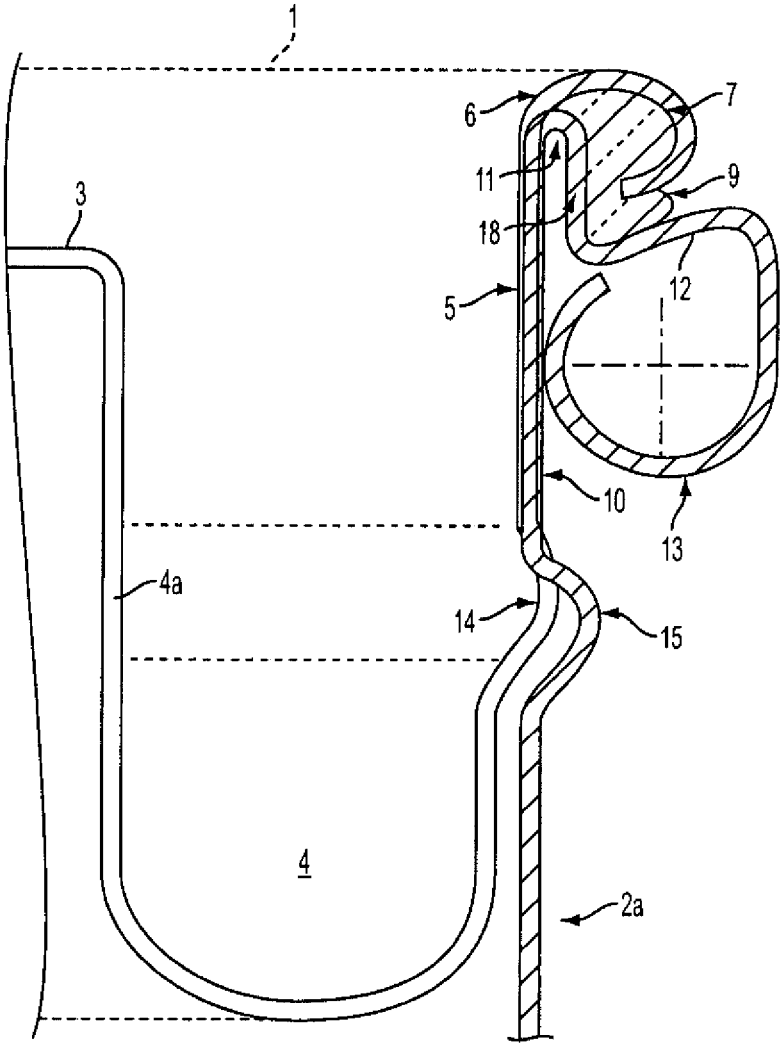
FIG. 2 shows the components as in FIG. 1, but in the closed position.

In order to mechanically secure the engagement of the lid with the body end after closing, the body wall 10 and the outer defining edge 5 of the lid 1 each possess a corrugation 15 or 14, or a similar engaging element. FIG. 1 shows the lid in a position facing the open body end immediately prior to the initiation of the insertion process according to the arrow 17. FIG. 2 shows the final closed position.

The open body end 10 with the bend 11 extends as far as possible into the interior of the rolled edge 7, approximately to the transition 6 between the outer defining edge 5 and the rolled edge 7 of the lid. The body barrel 10 enters into (direct or indirect) contact with the outer defining edge 5. This contact extends along the surfaces of the wall segments 5 and 10 and may occur under a radial preload as suggested schematically in FIG. 2 by the overlap of the sheet metal sectional surfaces. A residual layer of compound 9, which was displaced here, may be present on the outside. This also represents a contact of the defining edge 5 by the open body end.

By means of this contact, which is being established under preload, a reliable seal may already be accomplished by mechanical means between the two participating elements of the seal.

FIG. 2 further illustrates, that the radial distance of the sheet edge 8 from the defining edge 5 may be selected so that on the one hand the container neck with its bending radius 11 safely slide itself into the rolled edge 7 and that on the other hand the sealing material 9 within the rolled edge 7 and also outside in the are of the shoulder support may maintain a reliably continuous cross section. The sealing material herein may be maintained under pressure within the rolled edge 7, as well as between same and the support shoulder 12, thus substantially augmenting the sealing effect and making the application of an adhesive in the area of the sealing surfaces redundant.

The deep and wide channeled bead 4, the large rolled edge 7, the radial distance between the wall sections 10 and 18, the beveled support shoulder 12, and the large volume roll-in 13 at least adjacent to the body 10, in combination form a very effective cushioning and damping system, which may be capable of safely absorbing any impacts from pressure or shock, that may affect the area of the seal from the outside, without compromising seal effectiveness under these impacts.

The description and illustration of the seal clarifies, that the body end 10 with all elements of the seal—11, 18, 12, 13, and, if applicable, 16—can be formed from a single sheet metal blank. An additional intermediary ring is not required.

The lid can be essentially manufactured with known methods and means. The entire seal can thus be produced in a simple and economical manner, providing for excellent stability and tightness, thus making it suitable for hazardous materials containers.

Figure 3:
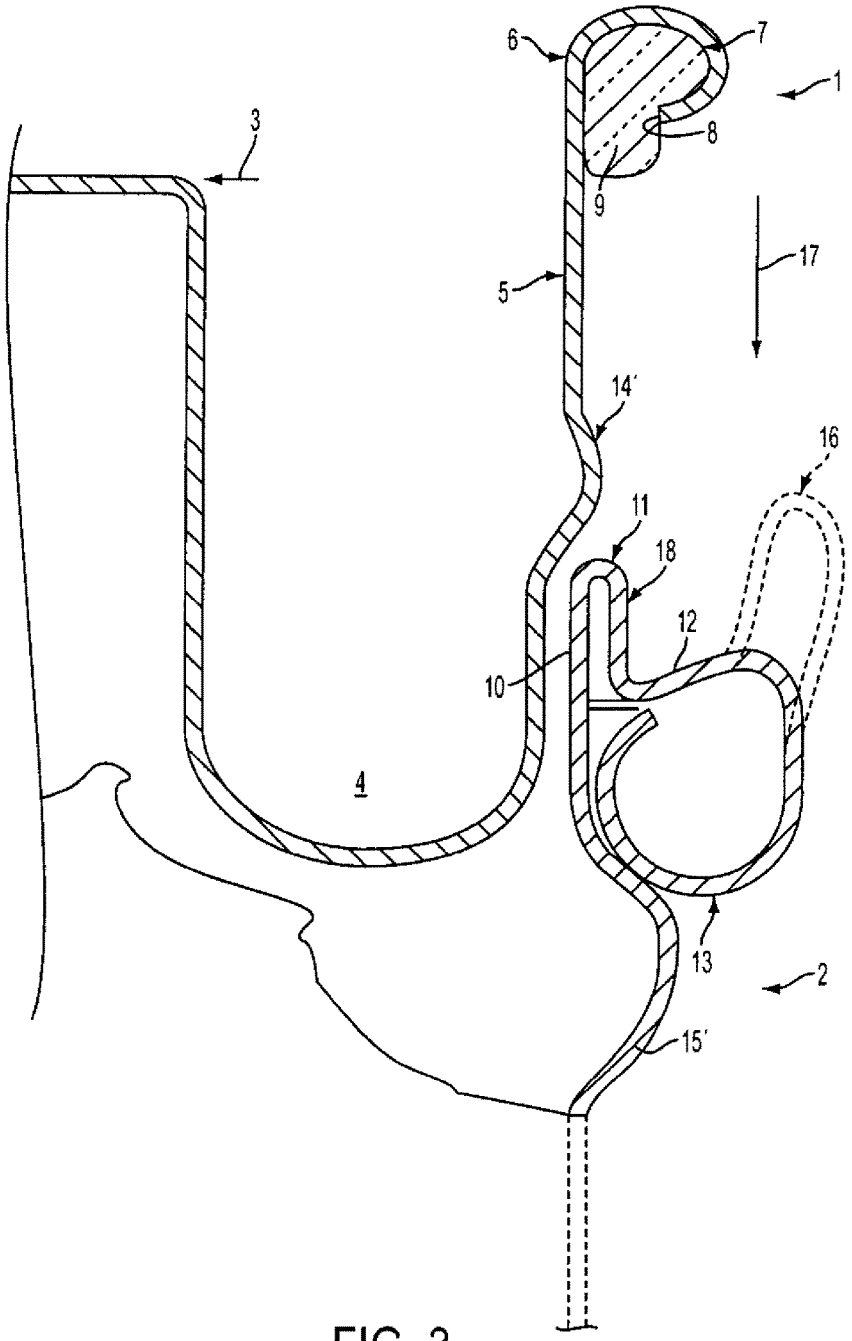
FIG. 3 shows a further embodiment.

In a further embodiment according to FIG. 3, reference can be made for the purpose of illustration to the unsealed state (depicting the state at the beginning of the closing process)—according to FIG. 1. Similarly, the closed state according to FIG. 2 can be transposed to FIG. 3 and is not depicted separately here.

The modification compared to the earlier described embodiments pertains to the body corrugation 15, which may be formed as a corrugation 15' in a more pronounced radial and outward manner, thus providing for a supporting effect to the annular roll-in 13. According to FIG. 1, the annular roll-in may be provided adjacent to the container body 10 (specifically the upper body section of container body 2), in particular in a contacting manner. If the corrugation 15 is moved to a higher axial position, a radial support of the roll-in 13 will result over a certain distance, thus additionally stabilizing the position of the support shoulder 12, possibly also the opening aid 16 as depicted (dashed lines) in a further exemplary embodiment.

The body or container corrugation 15' may also be provided axially more extended, but similarly also less extended, for example such as illustrated in FIG. 1.

The section 14' of the lid which is engaging into the corrugation 15' may be formed such that positive locking and/or a friction engagement may be achieved when assuming its closed position within the corrugation 15'. An at least partial degree of lateral support may also be provided, whereby the axial upward pressure of the corrugation 14' within the lid can be utilized for the further support of the corrugation 15' in the container, wherein both corrugations can jointly support the annular roll-in 13 in the radially inward, and the axially downward direction.

An interconnection of support corrugations and roll-ins, which join from all adjacent elements of the seal area, may be created.

What is claimed is:

1. A container comprising:

a container body and a lid and having an open position and a closed position;

a seal comprising an unsealed position and a sealed position;

the container body further having an upper body end, wherein in the open position the lid is away from the container body and for the closed position the lid is insertable into the upper body end to arrive at the closed position of the container;

wherein at the upper body end a terminal portion is curved by 180° providing a sharp upper end body curvature;

an outer wall of the lid extending axially upward, forming a u-shaped channel, an upper wall end portion of the outer wall is curved radially outwards with a lid curvature being less curved than the sharp upper end body curvature, the upper wall end portion thereby forming a rolling, wherein an annular sealing material is placed in the rolling and extends axially downwards from the rolling:

the rolling having a free edge directed towards the outer wall, holding the annular sealing material and terminating at a radial distance from the outer wall, said radial distance in the open position being filled by the sealing material, but allowing the sharp upper end body curvature to enter into an interior of the rolling, wherein the sharp upper end body curvature is in contact with an external surface of the outer wall and the annular sealing material to arrive at the closed position of the container and the sealed position of the seal.

2. The container of claim 1, wherein the upper body end is integrally formed from one sheet metal blank.

3. The container of claim 1, wherein the lid and the upper body end are held in the closed position by corrugations in the outer wall and in a body wall of the container body.

4. The container of claim 1, wherein a bending radius of an outer portion of the terminal portion of the upper body is rolled radially inward such that the portion that is rolled radially inward forms a curl and abuts against a circumferential radial protrusion of a body wall of the container.

5. The container of claim 1, wherein a diameter of the upper body end in an area of the sharp upper end body curvature and a lid edge diameter in an area of a transition between the outer wall and the curved portion are matched, such that in the closed position of the seal the sharp upper end body curvature abuts inwardly at a transition between the outer wall and the curved portion, while being under a radially inward tension.

6. The container of claim 1, wherein the annular sealing material is a swelling compound.

7. The container of claim 6, wherein the annular sealing material is a swelling compound.

8. The container of claim 4, wherein a portion between a support shoulder and the curl is formed into at least one of a radially and axially protruding extension.

9. The container of claim 8, wherein the extension is shaped to provide an opening aid for the lid to transfer the seal and the container into the open position.

10. The container of claim 1, wherein the free edge holding the sealing material and the outer wall of the lid define an opening for the sharp upper end body curvature.

11. The container of claim 1, wherein below the sharp upper end body curvature two parallel extending walls are formed, having a longitudinal extension of more than a diameter of the rolling.

12. The container of claim 11, wherein the two parallel walls are spaced apart for no more than four layers of thickness of a metal sheet thickness of each of the two walls.

13. The contain of claim 1, wherein the terminal portion that is curved by 180° forms a support shoulder radially further out from the 180° curve.

14. The contain of claim 13, wherein the axially downward extending sealing material comes to rest upon the support shoulder at the closed position of the container and the sealed position of the seal.

* * * * *